US005852837A

United States Patent [19]

Husting

[11] Patent Number: 5,852,837

[45] Date of Patent: Dec. 29, 1998

[54] MULTIPLE SECTION SUSPENDED BATH DOORS WITH A LOWER STABILIZER

[75] Inventor: Thomas J. Husting, Sheboygan Falls, Wis.

[73] Assignee: Kohler Co., Kohler, Wis.

[21] Appl. No.: 816,815

[22] Filed: Mar. 18, 1997

Related U.S. Application Data

[63] Continuation of Ser. No. 377,895, Jan. 25, 1995, abandoned.

[51] Int. Cl.[6] ..... A47K 3/22

[52] U.S. Cl. ..... 4/607; 49/409; 49/410

[58] Field of Search ..... 4/557, 607; 49/409, 49/410, 411

[56] References Cited

U.S. PATENT DOCUMENTS

| | | | |
|---|---|---|---|
| 2,751,637 | 6/1956 | Kraft | 49/125 |
| 2,850,089 | 9/1958 | Burke | 160/202 |
| 2,929,115 | 3/1960 | Beckstrom | 49/411 |
| 2,940,137 | 6/1960 | Blake | 49/411 |
| 3,100,916 | 8/1963 | McKinney | 49/410 X |
| 3,461,466 | 8/1969 | Weaver et al. | 4/557 |
| 3,529,382 | 9/1970 | Savlarola | 49/411 |
| 3,783,456 | 1/1974 | Doan | 4/557 |
| 3,805,450 | 4/1974 | Forcina | 49/231 |
| 3,896,508 | 7/1975 | Doan | 4/557 |
| 4,014,070 | 3/1977 | Rifkin | 49/410 X |
| 4,090,265 | 5/1978 | Baus | 4/607 |
| 4,358,863 | 11/1982 | Jacobsen | 4/607 |
| 4,445,239 | 5/1984 | Jacobsen | 4/607 |
| 4,458,449 | 7/1984 | Breuer | 49/411 |
| 4,785,485 | 11/1988 | Etesam | 4/557 |
| 4,882,795 | 11/1989 | Baus | 4/607 |
| 5,123,128 | 6/1992 | Hines | 4/557 |
| 5,297,301 | 3/1994 | Sodrel | 4/613 |

FOREIGN PATENT DOCUMENTS

| | | | |
|---|---|---|---|
| 4008160 | 9/1991 | Germany | 4/607 |

*Primary Examiner*—Robert M. Fetsuga
*Attorney, Agent, or Firm*—Quarles & Brady LLP

[57] ABSTRACT

A door system includes a sill having a ledge extending across the bottom of an opening to a bathing enclosure and having a raised lip along an exterior side of the ledge. A pair of parallel tracks are above the opening with a first door suspended from and slidable along the first track freely above the ledge. A second door and a third door are suspended from and slidable along the second track being freely suspended above the ledge. A pair of door retainers are attached to the first door and engage the other doors to prevent the doors from swinging into each other. A stop member is attached to the sill on an interior side of the ledge to retain three doors above the ledge between the stop member and the raised lip.

25 Claims, 4 Drawing Sheets

MULTIPLE SECTION SUSPENDED BATH DOORS WITH A LOWER STABILIZER

This is a continuation of application Ser. No. 08/377,895 filed Jan. 25, 1995, now abandoned.

BACKGROUND OF THE INVENTION

The present invention relates to sliding doors of the type commonly used as part of a shower or tub enclosure; and more particularly to multiple section shower/tub enclosure doors that are suspended from and slidable along an overhead track.

Tub and shower enclosures often have an opening that is closed with a pair of sliding doors. A common door assembly has a lower track mounted on the rim of the tub or shower pan and another track mounted directly overhead. Each door slides in a separate channel within the tracks and is able to slide past the other door. One of the drawbacks of this type of mechanism is that the lower track is an impediment to a bather entering and leaving the enclosure. The sharp edges of the lower track are undesirable to step upon and those edges also can scrape the feet of the bather. Thus, it is desirable to eliminate the use of a lower track.

However, the lower track provides several functions. Not only does it aid in guiding movement of the doors, but the lower track also restrict the doors from swinging inward and outward. Extreme inward or outward movement could dislodge the doors from the overhead track mechanism. Furthermore, the lower track provides a water barrier which directs water flowing against the doors into the tub or shower enclosure preventing water from flowing outward. Thus, eliminating the lower track of the door assembly also eliminates these beneficial functions provided by that track.

SUMMARY OF THE INVENTION

The general object of the present invention is to provide a sliding door assembly for a tub or shower enclosure which does not require a lower track.

Another object is to provide such a door assembly in which the doors slide along an overhead track and which incorporates a mechanism that restricts inward and outward movement of the lower edges of the doors.

A further object of the present invention is to provide a sill at the tub or shower enclosure opening which has a recess along an inner edge within which the doors are suspended. A raised lip on the outer side of the recess acts as a barrier to water passing under the doors and also directs water back into the bathing enclosure.

These objects are fulfilled by door system for a bathing enclosure which includes a track assembly extending above the opening. A pair of doors are suspended from and slidable along the track assembly, and are freely suspended above a portion of the sill. A door retainer is attached to the one door and has a projection which extends under the other door and upward on the remote side of the other door. A stop member is attached to the sill to retain the door 5 above the portion of the sill.

A three door version of the present concept for a bathing enclosure door system also is disclosed.

In the preferred embodiment of the door system, overlapping vertical edges of the doors have frame members attached thereto. A separate wing extends all along the frame member of each door toward the adjacent door. In the closed state of the doors the wings interlock to block water from flowing between the doors. However, the wings do not prevent the doors from being slid parallel to each other. In the three door version of the door system, the interlocking wings also enable the bather to pull on one door and drag an interlocked door along with the one door.

DETAILED DESCRIPTION OF THE INVENTION

Figure 1:
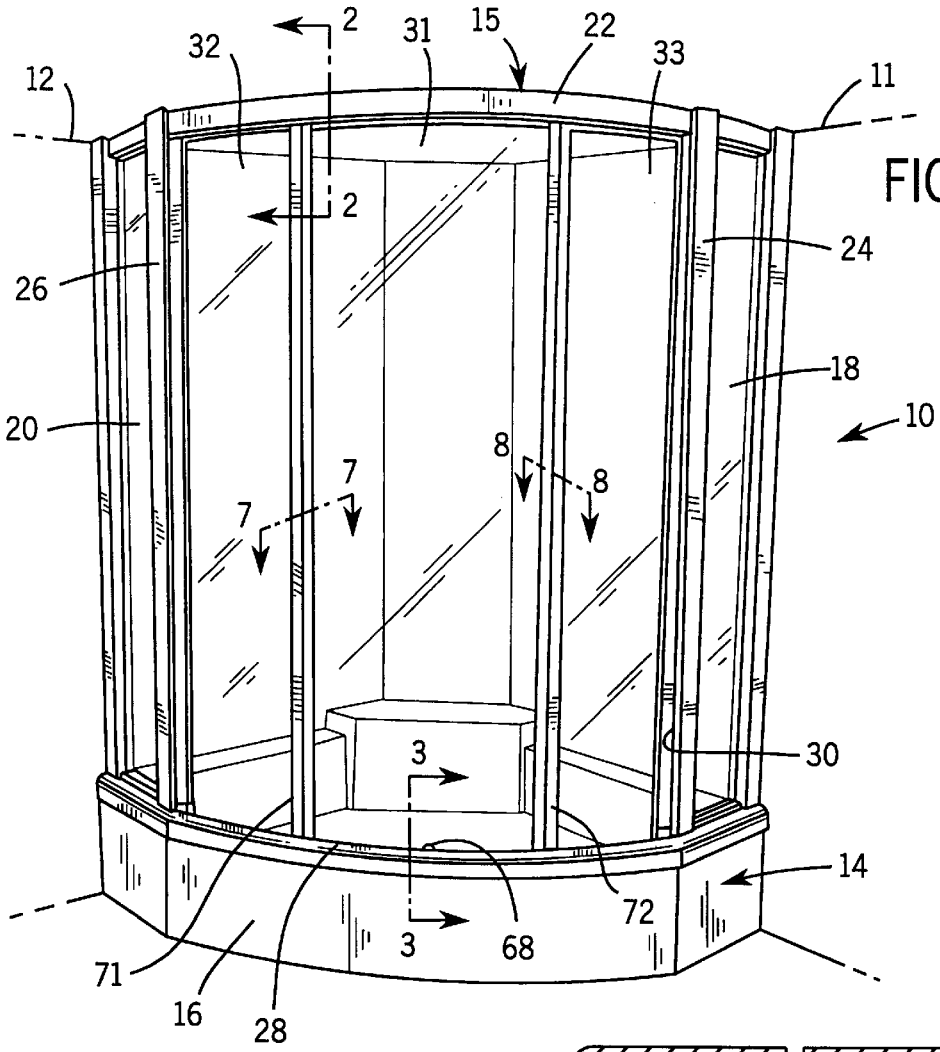
FIG. 1 is a pictorial representation of a corner shower enclosure incorporating a sliding door system according to the present invention.

With initial reference to FIG. 1, a shower enclosure 10 is located in a bathroom corner formed by walls 11 and 12. Although the present door system is being described in the context of a shower enclosure, it also can be applied to tubs and other bathing enclosures, as well as non-corner type enclosures. The shower enclosure 10 includes a floor outside pan 14 with a raised front barrier 16 extending between the two room walls 11 and 12. A set of stationary panels 18, 20 and a sliding door system 15 extend in a curving fashion between the two walls 11 and 12 above the front barrier 16. Specifically, one of the stationary glass panels 18 or 20 is attached to each of the room walls 11 and 12 and is sealed along a bottom edge to the front barrier 16 on the floor pan. The door system 15 includes a curved overhead track 22 which extends between a pair of vertical jambs 24 and 26 on the stationary glass panels 18 and 20. The two jambs 24 and 26 define the side boundaries of an opening 30 into the shower enclosure 10 and the overhead track 22 and a sill 28 of the front barrier 16 define upper and lower boundaries of the opening. A set of three glass-panel doors 31, 32 and 33 are suspended from the overhead track 22 and extend downward to the sill 28 of the floor pan 14. A center door 31 is flanked on both sides by narrower first and second side doors 32 and 33. The three doors 31–33 can slide in either direction along the overhead track 22 to create a passageway adjacent either jamb 24 or 26 through which a bather enters and exits the shower enclosure 10.

Figure 2:
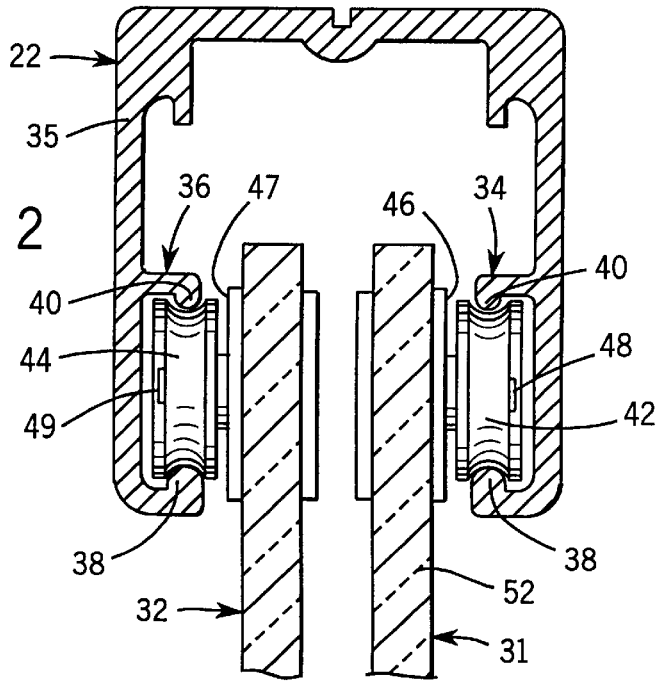
FIG. 2 is a cross-section view along line 2—2 in FIG. 1 through the overhead track of the door system.

With reference to FIG. 2, the curved overhead track 22 is formed by an elongated channel member 35 with an inverted U-shaped cross section and having inner and outer parallel tracks 34 and 36 within the opening of the U. Each track 34 and 36 has a lower rail 38 and an upper rail 40 between which pulley-like rollers 42 and 44 ride. Roller 42 is mounted on an axle 48 which is attached to a fastener 46 that extends through a hole near the top edge of the glass panel 52 of center door 31. The other illustrated roller 44 is mounted on axle 49 that is attached to a fastener 47 extending through a hole in the first side door 32. Two roller assemblies of this type are located in a spaced apart relationship along the top edge of each door 31–33. The rollers for the two side doors 32 and 33 ride on the outer track 36, while the center door rollers engage the parallel inner track 34.

Figure 3:
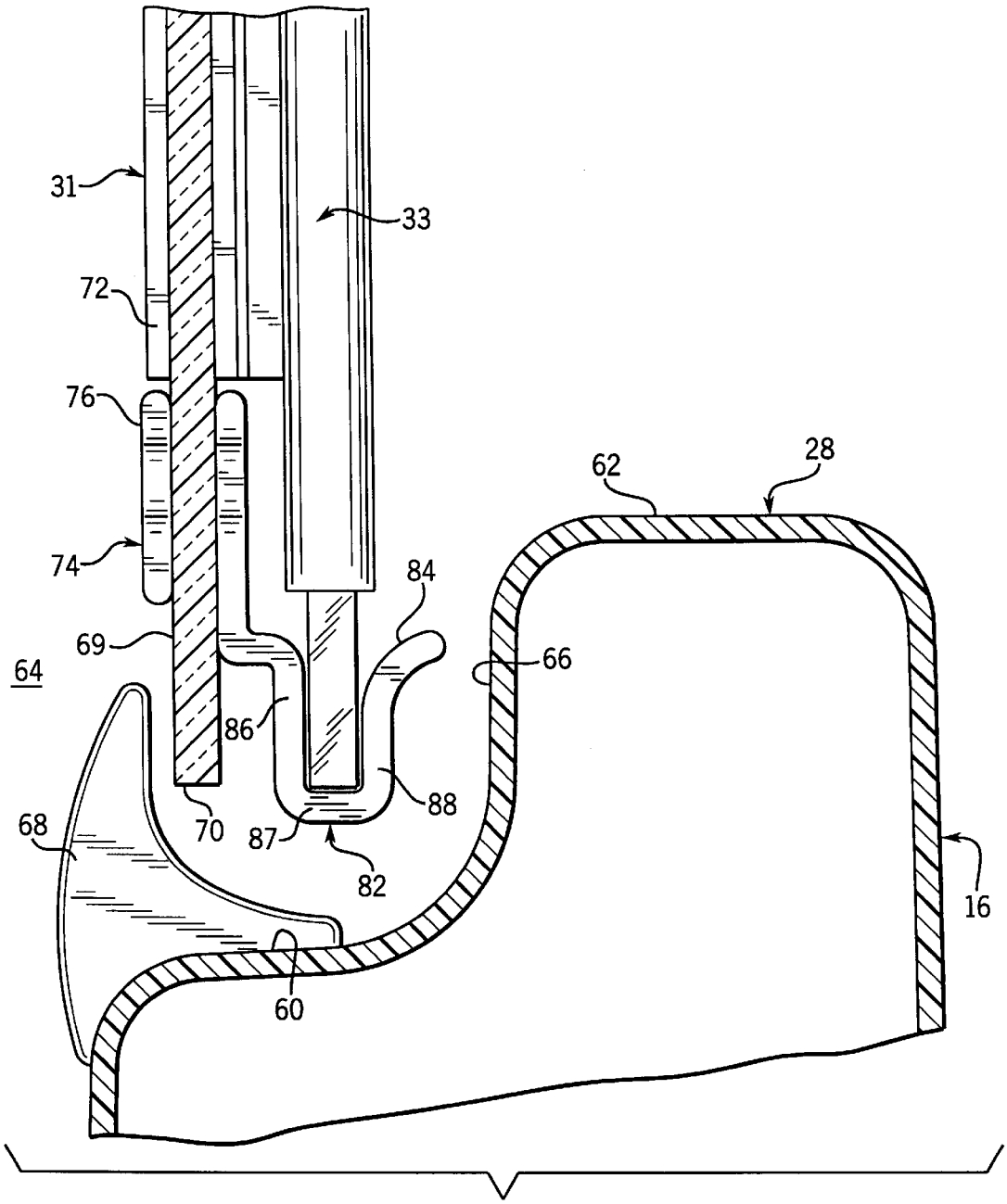
FIG. 3 is a cross-section view along line 3—3 in FIG. 1 through the sill of the shower enclosure.

The three doors 31–33 are freely suspended from the track 22 over the sill 28 of the shower floor pan 14. In other words, there is no lower track mechanism mounted on the lower sill 28 within which the doors 31–33 ride. With reference to FIG. 3, the barrier 16 of the shower floor pan 14 has a sill 28 with a generally horizontal ledge 60 and a raised lip 62 which extends along the ledge 60 on the exterior side of the sill 28. The two illustrated doors 31 and 33, as well as the other door 32, extend downward past the upper surface of the raised lip 62 into the recessed region formed by the lower ledge 60 and vertical lip wall 66. This recessed region extends along the interior edge of the sill 28 between the two vertical jambs 24 and 26. Because the sliding doors 31–33 extend below the horizontal upper surface of the raised lip 62, any water striking the inside surfaces of the doors flows downward onto ledge 60 and is directed into the shower enclosure chamber 64. The raised lip 62 on the outside of the sill 28 forms a barrier which prevents water from flowing under the doors 31–33 and onto a floor the shower enclosure 10.

Figure 4:
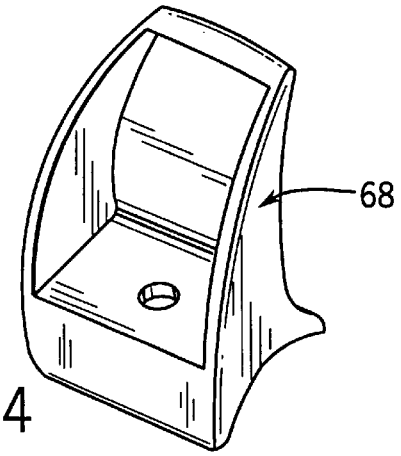
FIG. 4 is an isometric illustration of a stop member shown in FIG. 3.

As noted previously, the three sliding doors 31–33 are suspended freely above the ledge 60 of the floor pan sill 28. Because the doors extend below the raised lip 62 of the sill, the inner vertical surface 66 of the lip prevents the doors from swinging laterally outward. However, in the absence of a lower track, an additional mechanism must be provided to prevent the bottom edges of the doors 31–33 from swinging laterally into the shower enclosure chamber 64. Referring to FIGS. 3 and 4, this is accomplished by a narrow stop member 68 that is fastened to the inner edge of ledge 60 at the center of the opening 30 between the two jambs 24 and 26 (see also FIG. 1). The stop member 68 engages the inner major surface 69 of the center door 31 to restrict the inward lateral movement of that door. Because the center door 31 is slightly wider than one-half the width of the enclosure opening 30, the center door 31 never slides past the centrally positioned stop member 68. Thus, in all positions of the center door 31 along the overhead track 22, the center door will strike the stop member 68 upon significant inward lateral movement of the bottom edge 70 of the center door. Furthermore, the center door 31 always is between the entire stop member 68 and the sill lip 62 so that the stop member never is exposed wherein a bather entering or leaving the enclosure 10 could step on the stop member. As a result, the relatively narrow stop member does not present an impediment to the bather moving through the enclosure opening 30.

Figure 5:
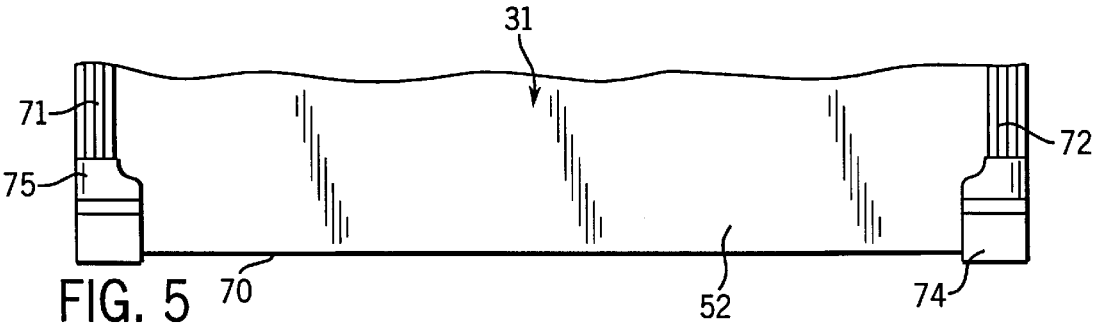
FIG. 5 shows the bottom section of the center door in FIG. 1.
Figure 6:
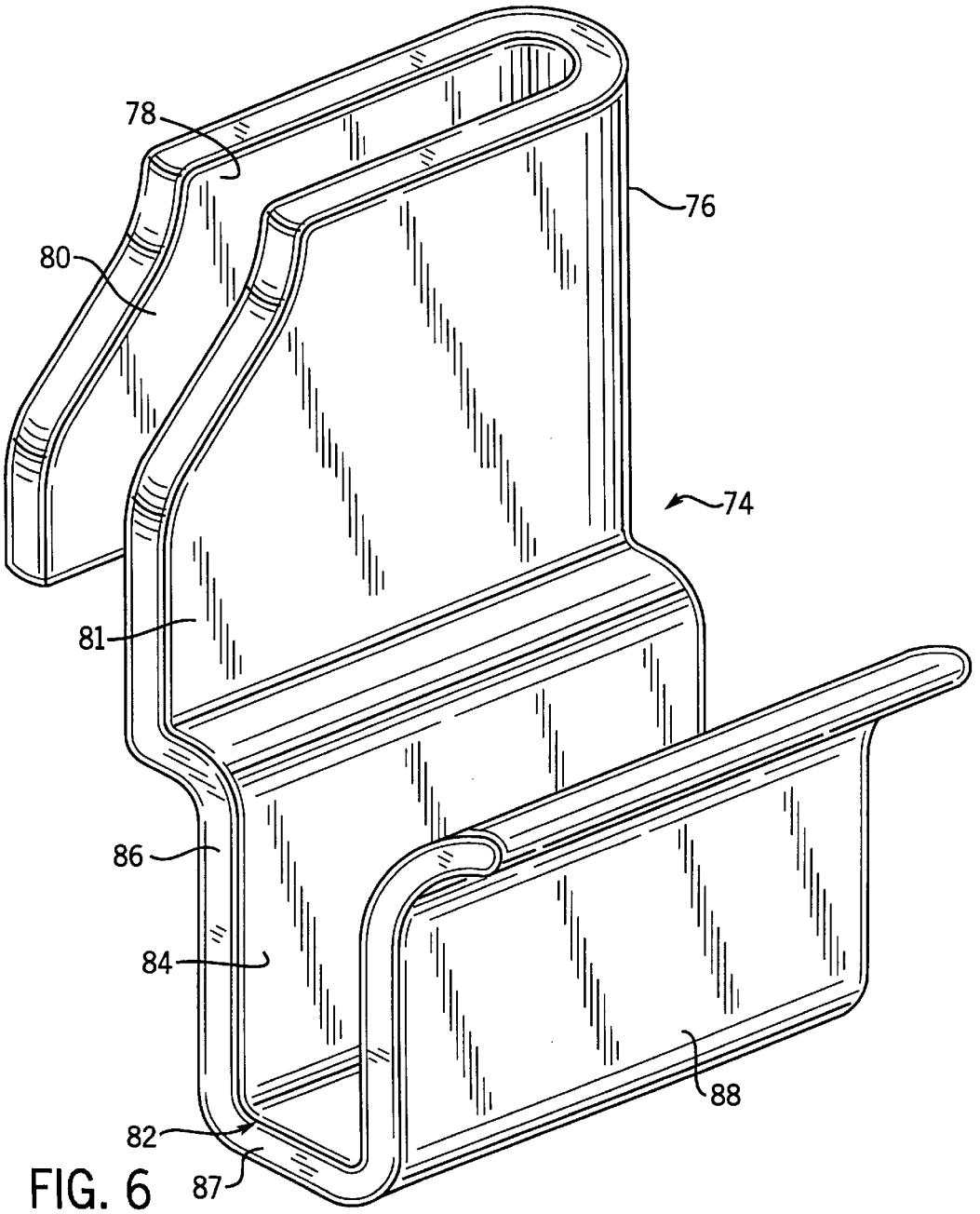
FIG. 6 is an isometric representation of a door retainer element shown in FIG. 3.

The center door 31 has two vertical side frame members 71 and 72 shown in FIG. 5. A separate door retainer 74 and 75 is attached near the bottom of the center door adjacent side frame members 71 and 72. The two door retainers 74 and 75 are similar being mirror images of each other. With reference to FIGS. 3 and 6, door retainer 74 has a horizontally oriented U-shaped clip 76 with a first channel 78 formed between plates 80 and 81. The first channel 78 receives the side edge of the center door 31 in a secure manner to firmly attach the door retainer 74 to that door. A hook-like door guide 82 extends downward from the plate 81 that is toward the outside of the shower enclosure 10. The door guide 82 has a portion 86 that extends downward along a side of the second side door 33 which is proximate to the center door 31. A horizontal portion 87 of the door guide 82 is connected to the bottom of portion 86 and projects under the lower edge of the adjacent second side door 33. Yet another portion 88 projects upward from the horizontal portion 87 on the remote side of second side door 33 from the center door 31. Portions 86, 87 and 88 of the door guide 82 form a second channel 84 within which the second side door 33 slides adjacent to the center door 31.

The two door retainers 74 and 75 restrict lateral movement of the three doors 31–33 with respect to one another because the first and second side doors 32 and 33 are coupled to the center door 31 via the door retainers. This prevents the bottom edges of the doors from swinging forcefully against each other. As noted previously, the sill lip 62 and stop member 68 restrict the doors 31–33 from swinging laterally inward and outward.

Figure 7:
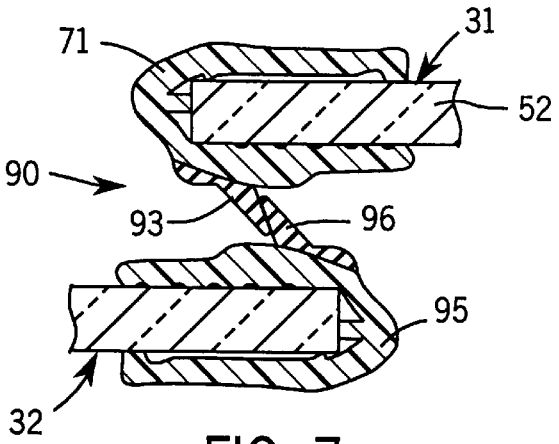
FIG. 7 is a cross section view along line 7—7 in FIG. 1.

In order to prevent the center door 31 from sliding beyond each of the two side doors 32 or 33 in which case the side door would travel out of the second channel 84 in the associated door retainer 74 or 75, the vertical edges of the doors 31–33 which overlap are provided with interlock mechanisms. The interlock mechanism 90 between the center door 31 and first side door 32 is shown in detail in FIG. 7. The center door 31 has a glass panel 52 with a side frame member 71, that is formed of a rigid poly-vinyl chloride compound, having a U-shaped cross-section which tightly grips a vertical edge of the center door 31. On the exterior side of the side frame member 71 is a first wing 93 formed of a resilient plastic or rubber material. The first wing 93 projects at an angle toward the exterior of the shower enclosure 10. The first side door 32 has another side frame member 95 attached along its vertical edge which is remote from jamb 26. A second resilient wing 96 projects from the interior side of side frame member 95 and is pointed toward the interior of the shower enclosure 10. The vertical edge of center door 31 that is proximate to jamb 26 and the vertical edge of first side door 32 that is remote from jamb 26 overlap so that the wings 93 and 96 interlock when these doors are pulled away from each other as shown in FIG. 7.

This interlocking relationship prevents the center door 31 from sliding to the right in FIG. 1 entirely past the edge of the first side door 32. When a bather pulls on the first side door 32, the center door 31 is dragged along when the wings 93 and 96 interlock. The interlocking of the wings 93 and 96 also prevents the first side door 32 from sliding out of the channel in door retainer 75. However, the interlocking mechanism does not restrict the first and second side doors 32 and 33 from sliding into an overlapping relationship with the center door 31 to provide an passageway within opening 30 through which the bather can ingress and egress the enclosure 10.

In the fully closed state of the doors illustrated in FIG. 1, the wings 93 and 96 also are in an interlocking or near interlocking state and provide a barrier to water flowing out of enclosure 10 between the two door frame members 71 and 95. Thus, any water that is directed between the doors 31 and 32 will be deflected back into the shower enclosure 10.

Figure 8:
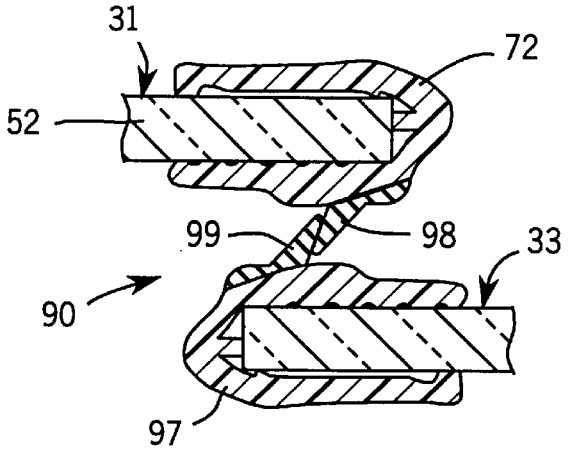
FIG. 8 is a cross section view along line 8—8 in FIG. 1.

As shown in FIG. 8, similar door frame members 72 and 97 are provided on the overlapping vertical edges of the center door 31 and the second side door 33. These frame members 72 and 97 have wings 98 and 99, respectively, which serve the same functions as wings 93 and 96.

I claim:

1. A door system for a bathing enclosure having a fixture that has raised barrier above which is an opening, said door system for selectively closing the opening and comprising:

a track assembly extending above the raised barrier;

a first door and a second door both of which are suspended from and slidable along said track assembly, and which are freely suspended above a portion of the raised barrier enabling said first and second doors to swing with respect to each other;

a third door suspended from and slidable along the track assembly;

a first door retainer attached to said first door and having a projection extending under said second door and upward on a side of said second door that is remote from said first door, said first door retainer restricting how much said second door may swing away from said first door;

a first wing extending along a vertical edge of said first door;

a second wing extending along a vertical edge of said second door, wherein the first wing abuts the second wing to prevent said first door and said second door from sliding entirely past one another; and a stop member attached to the raised barrier and retaining said first door above the portion of the raised barrier.

2. The door system as recited in claim 1 wherein said stop member is attached to the raised barrier at substantially a center of the opening.

3. The door system as recited in claim 1 wherein the protection of said first door retainer comprises a U-shaped guide within which a lower edge of said second door is received.

4. The door system as recited in claim 1 wherein said first door retainer comprises a U-shaped clip within which the first door is securely received; and wherein the projection of said first door retainer comprises a U-shaped guide attached to the U-shaped clip and within which a lower edge of said second door is received.

5. The door system as recited in claim 1 wherein said first door retainer comprises a horizontal U-shaped clip within which the first door is securely received; and wherein the projection of said first door retainer comprises a vertical U-shaped guide attached to the U-shaped clip and within which a lower edge of said second door is received.

6. The door system as recited in claim 1 wherein said track assembly comprises a first track with said first door suspended therefrom, and a second track substantially parallel to the first track and having said second door suspended therefrom.

7. The door system recited in claim 6 wherein the third door is suspended from and slidable along the second track.

8. The door system as recited in claim 7 further comprising a third wing extending along another vertical edge of said first door, and a fourth wing extending along a vertical edge of said third door; wherein the third wing abuts the fourth wing to prevent said first door and said third door from sliding entirely past one another.

9. The door system as recited in claim 7 wherein each of said first door, said second door and said third door has two substantially vertical frame members, the first wing extends from one vertical frame member of said first door, and the second wing extends from one vertical frame member of said second door; and further comprising a third wing extending from another vertical frame member of said first door, and a fourth wing extending from one vertical frame member of said third door, wherein the third wing abuts the fourth wing to prevent said first door and said third door from sliding entirely past each other.

10. The door system as recited in claim 7 further comprising a second door retainer attached to said first door and having a projection extending under said third door and upward on a side of said third door that is remote from said first door.

11. The door system as recited in claim 10 wherein the projection of said second door retainer comprises a U-shaped guide within which a lower edge of said third door is received.

12. The door system as recited in claim 10 wherein said second door retainer comprises a U-shaped clip within which the second door is securely received; and wherein the projection of said first door retainer comprises a U-shaped guide attached to the U-shaped clip and within which a lower edge of said third door is received.

13. The door system as recited in claim 1 wherein each of said first door and said second door has two substantially vertical frame members; and the first wing extending from one frame member of said first door, and the second wing extending from one vertical frame member of said second door.

14. A door system for a bathing enclosure having an opening between two side jambs, said door system comprising:

a sill defining a lower boundary of the opening and having a ledge extending between the two side jambs and a raised lip extending along an exterior side of the ledge;

a track assembly extending above the opening;

a first door and a second door suspended from and slidable in parallel paths along said track assembly, and freely suspended above the ledge enabling said first and second doors to swing with respect to each other;

a door retainer attached to said first door and having a projection extending under said second door and upward on a side of said second door that is remote from said first door thereby forming a channel within which said second door slides, said first door retainer restricting how much said second door may swing away from said first door; and a stop member attached to the sill on an interior side of the ledge to retain said first and second doors above the ledge between the stop member and the raised lip.

15. The door system as recited in claim 14 wherein said stop member is located at substantially a center of the opening.

16. The door system as recited in claim 14 wherein said stop member is attached to the sill at a location wherein at least one of said first door and said second door is always between the raised lip and an entirety of said stop member thereby preventing a bather from stepping on said stop member.

17. The door system as recited in claim 14 wherein said door retainer comprises a U-shaped guide within which a lower edge of said second door is received.

18. The door system as recited in claim 14 wherein said first door retainer comprises a U-shaped clip within which the first door is securely received; and a U-shaped guide attached to the U-shaped clip and within which a lower edge of said second door is received.

19. The door system as recited in claim 18 wherein said U-shaped clip is orthogonally oriented with respect to said U-shaped guide.

20. A door system for a bathing enclosure having an opening between two side jambs, said door system comprising:

a sill defining a lower boundary of the opening and having a ledge extending between the side jambs and a raised lip extending along an exterior side of the ledge;

a first track and a second track extending parallel to each other above the opening between the two side jambs;

a first door suspended from and slidable along said first track, and freely suspended above the ledge;

a second door and a third door suspended from and slidable along said second track, and freely suspended above the ledge;

a first door retainer and a second door retainer attached to said first door, wherein said first door retainer has a first projection extending under said second door and upward on a side of said second door that is remote from said first door thereby forming a channel within which said second door slides, and wherein said second door retainer has a second projection extending under said third door and upward on a side of said third door that is remote from said first door thereby forming another channel within which said third door slides; and a stop member attached to the sill on an interior side of the ledge to retain said first door, said second door and said third door above the ledge between said stop member and the raised lip.

21. The door system as recited in claim 20 wherein said first door has two vertical side edges; and one of said first door retainer and said second door retainer are attached to said first door along a different vertical side edge.

22. The door system as recited in claim 20 wherein each of said first door, said second door and said third door has two substantially vertical frame members; and further comprising a first wing extending from one vertical frame member of said first door, a second wing extending from another vertical frame member of said first door, a third wing extending from one vertical frame member of said second door, and a fourth wing extending from one vertical frame member of said third door; wherein the first wing abuts the third wing to prevent said first door and said second door from sliding entirely past each other, and the second wing abuts the fourth wing to prevent said first door and said third door from sliding entirely past each other.

23. The door system as recited in claim 20 wherein said first door has first and second vertical side edges, said first door retainer being attached to the first vertical side edge and said second door retainer being attached to the second vertical side edge.

24. The door system as recited in claim 20 wherein each of said first door retainer and said second door retainer comprises a U-shaped clip within which the first door is securely received; and a U-shaped guide attached to the U-shaped clip and within which a lower edge of one of said second door and said third door is received.

25. The door system as recited in claim 24 wherein the U-shaped clip is orthogonally oriented with respect to the U-shaped guide.

* * * * *